US010259040B2

(12) United States Patent
Mizuno et al.

(10) Patent No.: US 10,259,040 B2
(45) Date of Patent: Apr. 16, 2019

(54) LUBRICANT FOR METAL POWDER METALLURGY, METHOD OF PRODUCING SAME, METAL POWDER COMPOSITION, AND METHOD OF PRODUCING METAL POWDER METALLURGY PRODUCT

(71) Applicants: ADEKA CORPORATION, Tokyo (JP); ADEKA CHEMICAL SUPPLY CORPORATION, Tokyo (JP)

(72) Inventors: Yukou Mizuno, Tokyo (JP); Kyoushi Adachi, Tokyo (JP)

(73) Assignees: ADEKA CORPORATION, Tokyo (JP); ADEKA CHEMICAL SUPPLY CORPORATION, Tokyo (JP)

( * ) Notice: Subject to any disclaimer, the term of this patent is extended or adjusted under 35 U.S.C. 154(b) by 862 days.

(21) Appl. No.: 14/764,603

(22) PCT Filed: Feb. 4, 2014

(86) PCT No.: PCT/JP2014/052529
§ 371 (c)(1),
(2) Date: Jul. 30, 2015

(87) PCT Pub. No.: WO2014/123106
PCT Pub. Date: Aug. 14, 2014

(65) Prior Publication Data

US 2015/0367413 A1 Dec. 24, 2015

(30) Foreign Application Priority Data

Feb. 5, 2013 (JP) ..... 2013-020479

(51) Int. Cl.
*B22F 1/00* (2006.01)
*B22F 9/02* (2006.01)
(Continued)

(52) U.S. Cl.
CPC ..... *B22F 1/0059* (2013.01); *B22F 1/0014* (2013.01); *B22F 9/026* (2013.01);
(Continued)

(58) Field of Classification Search
CPC ..... B22F 1/0014; B22F 1/0059; B22F 9/026; C10M 105/68
See application file for complete search history.

(56) References Cited

U.S. PATENT DOCUMENTS 7,150,775 B2 * 12/2006 Tavares ..... A61L 27/16 75/252
7,261,759 B2 * 8/2007 Tavares ..... A61L 27/16 419/62
(Continued)

FOREIGN PATENT DOCUMENTS

JP 56-136901 10/1981
JP 63-103001 5/1988
(Continued)

OTHER PUBLICATIONS

International Search Report dated Apr. 1, 2014 in International (PCT) Application No. PCT/JP2014/052529.

*Primary Examiner* — Cam N. Nguyen
(74) *Attorney, Agent, or Firm* — Wenderoth, Lind & Ponack, L.L.P.

(57) ABSTRACT

The lubricant for metal powder metallurgy of the present invention consists of particulates that contain at least one amide compound selected from the group consisting of amide compounds represented by general formula (1) below and amide compounds represented by general formula (2) below, wherein particulates with a particle diameter larger than 198 μm are less than 1 mass % and particulates with a diameter of 10 μm or less are not more than 10 mass %, $$R^1—CONH—(CH_2)_m—NHCO—R^2 \quad (1)$$

(Continued)

wherein, $R^1$ and $R^2$ each independently represent a $C_{13-27}$ aliphatic hydrocarbon group and m represents a number from 1 to 6, $$R^3—CONH_2 \quad (2)$$

wherein, $R^3$ represents a $C_{13-27}$ aliphatic hydrocarbon group. The lubricant for metal powder metallurgy of the present invention realizes low rattler values and low densities without inhibition of the lubricity, and can provide green bodies and sintered bodies free of cracking, chipping, and density imbalances.

12 Claims, 2 Drawing Sheets

(51) Int. Cl.
*C10M 105/68* (2006.01)
*B22F 3/02* (2006.01)

(52) U.S. Cl.
CPC ..... *C10M 105/68* (2013.01); *B22F 1/0077* (2013.01); *B22F 2001/0066* (2013.01); *B22F 2003/023* (2013.01); *B22F 2998/10* (2013.01); *C10M 2215/0806* (2013.01); *C10N 2220/082* (2013.01); *C10N 2230/00* (2013.01); *C10N 2230/06* (2013.01); *C10N 2240/00* (2013.01)

(56) References Cited

U.S. PATENT DOCUMENTS

| | | | | |
|---|---|---|---|---|
| 7,329,302 | B2 * | 2/2008 | McCall | B22F 1/0059 419/37 |
| 7,494,600 | B2 * | 2/2009 | Kjellen | B22F 1/0059 148/104 |
| 7,789,934 | B2 * | 9/2010 | Suzuki | B22F 1/0059 75/252 |
| 10,030,209 | B2 * | 7/2018 | Thomas | C10M 171/06 |

FOREIGN PATENT DOCUMENTS

| | | |
|---|---|---|
| JP | 06-010001 | 1/1994 |
| JP | 2003-293001 | 10/2003 |
| JP | 2004-002964 | 1/2004 |
| JP | 2005-095939 | 4/2005 |
| JP | 2005-264201 | 9/2005 |
| JP | 2005-307348 | 11/2005 |
| JP | 2005-330499 | 12/2005 |
| JP | 2005-330557 | 12/2005 |
| WO | 2005/087411 | 9/2005 |

* cited by examiner

LUBRICANT FOR METAL POWDER METALLURGY, METHOD OF PRODUCING SAME, METAL POWDER COMPOSITION, AND METHOD OF PRODUCING METAL POWDER METALLURGY PRODUCT

TECHNICAL FIELD

The present invention relates to a powder lubricant used in metal powder metallurgy and more particularly relates to a lubricant for metal powder metallurgy that can efficiently produce a low-density sintered body that presents little cracking or chipping.

BACKGROUND ART

Powder metallurgy methods have been used as methods that can provide metal parts in any shape, and yield a metallurgical product primarily by mixing a lubricant into metal particles (powder) to give a metallurgical starting material, press molding this metallurgical starting material into a molding, and sintering this molding. A high-density or low-density metallurgical product may be obtained from press molding depending on the pressure, etc., but there has been strong demand in recent years for lighter metal parts and the demand for low-density metallurgical products has thus been increasing.

Patent Document 1 describes a metal powder mixture for powder metallurgy that is obtained by mixing polyethylene glycol, polypropylene glycol, glycerol, or polyvinyl alcohol as a binder into an iron or steel powder. Patent Document 2 describes a metal powder mixture for powder metallurgy that is obtained by mechanically mixing a binder selected from the group consisting of vinyl acetate copolymers, cellulose ester resins, methacrylic resins, alkyd resins, polyurethane resins, and polyester resins, into powder for alloying. Patent Document 3 describes a metal powder mixture for powder metallurgy that is based on ferrous powder and that contains a polyalkylene oxide having a number-average molecular weight of at least approximately 7,000 as a binder. However, all of these provide high-density green bodies (the molding prior to sintering) that have relative densities with reference to the ingot material in excess of 90% (represented by the "compression ratio" in Patent Document 1, the "unsintered density" in Patent Document 2, and the "green density" in Patent Document 3) and cannot provide low-density green bodies having low rattler values.

On the other hand, metal particles provided by granulation using agar are used in Patent Document 4, but this cannot provide a green body that realizes a low rattler value without inhibition of the lubricity and that is free of cracking, chipping, and density imbalances. Patent Document 5 describes a lubricating binder for low-density powder metallurgy, which uses an oxyalkylene polymer chain-containing polymer as a binder. However, the rattler values specifically reported in the examples of Patent Document 5 are from 3.8 to 4.5 (refer to Examples 8 to 15), and green bodies free of cracking, chipping, and density imbalances cannot be obtained with such rattler values at an actual facility for producing low-density powder metallurgy parts. There is thus desire for the realization of even lower rattler values at production facilities.

Patent Document 1: Japanese Patent Application Laid-open No. 56-136901

Patent Document 2: Japanese Patent Application Laid-open No. 63-103001

Patent Document 3: Japanese Patent Application Laid-open No. 6-10001

Patent Document 4: Japanese Patent Application Laid-open No. 2003-293001

Patent Document 5: Japanese Patent Application Laid-open No. 2005-330557

SUMMARY OF INVENTION

Technical Problem

An object of the present invention is therefore to provide a lubricant for metal powder metallurgy, that can realize low rattler values and low densities without inhibition of the lubricity and that can provide green bodies and sintered bodies free of cracking, chipping, and density imbalances. A further object of the present invention is to provide a method of producing this lubricant for metal powder metallurgy. An additional object of the present invention is to provide a method of producing green bodies and sintered bodies free of cracking, chipping, and density imbalances, that realizes low rattler values and low densities.

Solution to the Problem

The present inventors have carried out intensive investigations and discovered a lubricant for metal powder metallurgy that yields green bodies that have low rattler values even with low densities; to achieve the present invention.

That is, the present invention is a lubricant for metal powder metallurgy, which is formed of particulates that contain at least one amide compound selected from the group consisting of amide compounds represented by general formula (1) below and amide compounds represented by general formula (2) below, wherein particulates with a particle diameter larger than 198 μm are less than 1 mass % and particulates with a diameter of 10 μm or less are not more than 10 mass %.

$$R^1\text{—}CONH\text{-}(CH_2)_m\text{-}NHCO\text{—}R^2 \quad (1)$$

(in the formula, $R^1$ and $R^2$ each independently represent a $C_{13-27}$ aliphatic hydrocarbon group and m represents a number from 1 to 6)

$$R^3\text{—}CONH_2 \quad (2)$$

(in the formula, $R^3$ represents a $C_{13-27}$ aliphatic hydrocarbon group)

The present invention is also a method of producing a lubricant for metal powder metallurgy, the method comprising: melt-mixing the aforementioned amide compound, and then spraying the mixture to form particulates.

The present invention is also a method of producing a metal powder metallurgy product, the method comprising: mixing 0.01 to 10 mass parts of the aforementioned lubricant for metal powder metallurgy with 100 mass parts of metal particles having a median diameter of 5 to 300 μm; press molding the mixture to obtain a green body having a relative density, with respect to an ingot material having the same component composition as the metal particles, of not more than 90%; and sintering this green body to obtain a sintered body.

Advantageous Effects of the Invention

The present invention provides a lubricant for metal powder metallurgy, that can realize low rattler values and low densities without inhibition of the lubricity and that can provide green bodies and sintered bodies free of cracking, chipping, and density imbalances. The present invention also provides a method of producing the lubricant for metal powder metallurgy. The present invention further provides a method of producing green bodies and sintered bodies free of cracking, chipping, and density imbalances, that realizes low rattler values and low densities.

DESCRIPTION OF EMBODIMENTS

Figure 1:
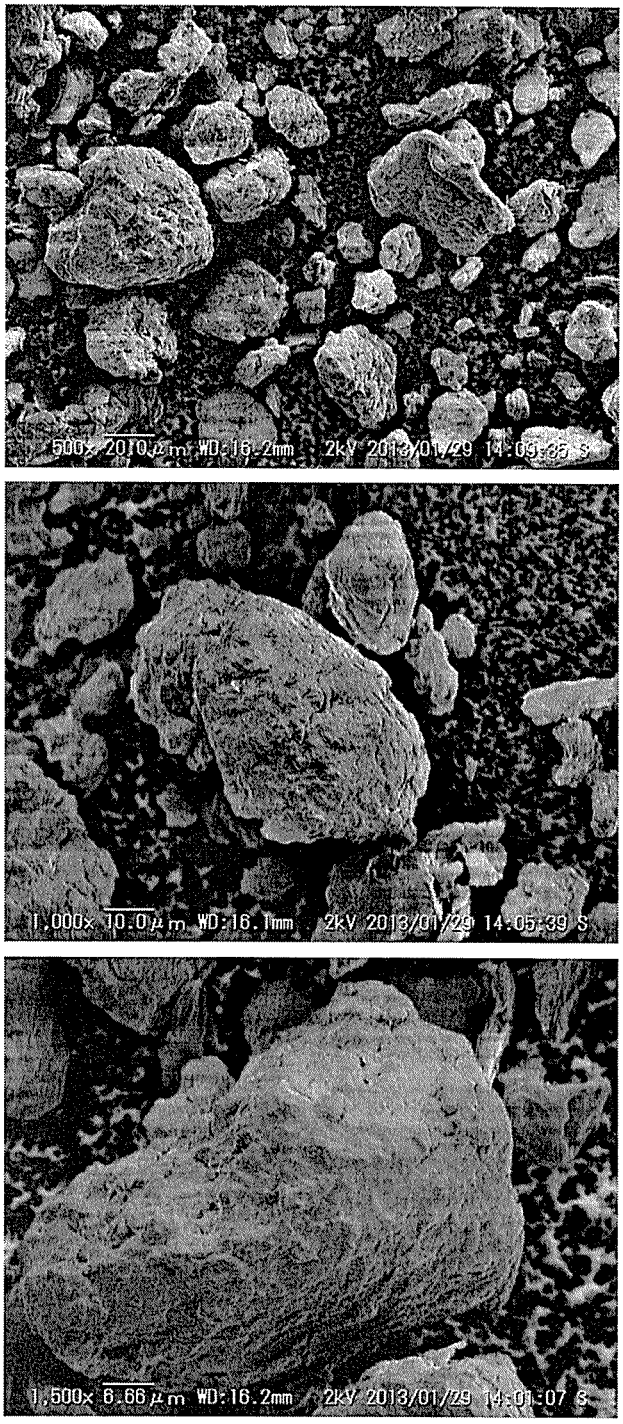
FIG. 1 is an electron micrograph of the lubricant for metal powder metallurgy according to the present invention, that has been obtained by a pulverization method.

The lubricant for metal powder metallurgy of the present invention is constituted of particulates that contain at least one amide compound selected from the group consisting of amide compounds represented by general formula (1) below and amide compounds represented by general formula (2) below.

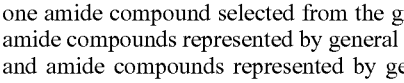

$$R^1—CONH(CH_2)_mNHCO—R^2 \quad (1)$$

(in the formula, $R^1$ and $R^2$ each independently represent a $C_{13-27}$ aliphatic hydrocarbon group and m represents a number from 1 to 6)

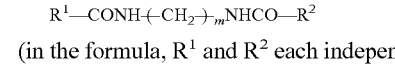

$$R^3—CONH_2 \quad (2)$$

(in the formula, $R^3$ represents a $C_{13-27}$ aliphatic hydrocarbon group)

In general formula (1) $R^1$ and $R^2$ each independently represent a $C_{13-27}$ aliphatic hydrocarbon group. Examples of the aliphatic hydrocarbon group include alkyl groups such as the tridecyl group, isotridecyl group, tetradecyl group, isotetradecyl group, pentadecyl group, isopentadecyl group, hexadecyl group, isohexadecyl group, heptadecyl group, isoheptadecyl group, octadecyl group, isooctadecyl group, nonadecyl group, isononadecyl group, eicosyl group, isoeicosyl group, heneicosyl group, isoheneicosyl group, docosyl group, isodocosyl group, tricosyl group, isotricosyl group, tetracosyl group, isotetracosyl group, pentacosyl group, isopentacosyl group, hexacosyl group, isohexacosyl group, heptacosyl group, and isoheptacosyl group; and alkenyl groups such as the tridecenyl group, isotridecenyl group, tetradecenyl group, isotetradecenyl group, pentadecenyl group, isopentadecenyl group, hexadecenyl group, isohexadecenyl group, heptadecenyl group, isoheptadecenyl group, octadecenyl group, isooctadecenyl group, nonadecenyl group, isononadecenyl group, eicosenyl group, isoeicosenyl group, heneicosenyl group, isoheneicosenyl group, docosenyl group, isodocosenyl group, tricosenyl group, isotricosenyl group, tetracosenyl group, isotetracosenyl group, pentacosenyl group, isopentacosenyl group, hexacosenyl group, isohexacosenyl group, heptacosenyl group, and isoheptacosenyl group. Among them, $C_{15-21}$ aliphatic hydrocarbon groups are preferred and $C_{15-19}$ aliphatic hydrocarbon groups are more preferred.

In general formula (1) m is a number from 1 to 6, and the group between the two amide groups is then a methylene group, ethylene group, propylene group, butylene group, pentylene group, or hexylene group in correspondence to the change in m. Among them, m is preferably a number from 1 to 4 in terms of availability.

There are no limitations on the method of producing the amide compound represented by general formula (1), and production may be carried out by any known method. However, the following are preferred because they allow easy production: methods in which a dehydration reaction is run between 1 mol of each of the fatty acids represented by $R^1COOH$ and $R^2COOH$ and, for example, methylenediamine, ethylenediamine, propylenediamine, butylenediamine, pentylenediamine, or hexylenediamine, and methods in which a demethanolization reaction is run between 1 mol of each of the fatty acid methyl esters represented by $R^1COOMe$ and $R^2COOMe$ and, for example, methylenediamine, ethylenediamine, propylenediamine, butylenediamine, pentylenediamine, or hexylenediamine.

In general formula (2) $R^3$ represents a $C_{13-27}$ aliphatic hydrocarbon group. Examples of the aliphatic hydrocarbon group include alkyl groups such as the tridecyl group, isotridecyl group, tetradecyl group, isotetradecyl group, pentadecyl group, isopentadecyl group, hexadecyl group, isohexadecyl group, heptadecyl group, isoheptadecyl group, octadecyl group, isooctadecyl group, nonadecyl group, isononadecyl group, eicosyl group, isoeicosyl group, heneicosyl group, isoheneicosyl group, docosyl group, isodocosyl group, tricosyl group, isotricosyl group, tetracosyl group, isotetracosyl group, pentacosyl group, isopentacosyl group, hexacosyl group, isohexacosyl group, heptacosyl group, and isoheptacosyl group; and alkenyl groups such as the tridecenyl group, isotridecenyl group, tetradecenyl group, isotetradecenyl group, pentadecenyl group, isopentadecenyl group, hexadecenyl group, isohexadecenyl group, heptadecenyl group, isoheptadecenyl group, octadecenyl group, isooctadecenyl group, nonadecenyl group, isononadecenyl group, eicosenyl group, isoeicosenyl group, heneicosenyl group, isoheneicosenyl group, docosenyl group, isodocosenyl group, tricosenyl group, isotricosenyl group, tetracosenyl group, isotetracosenyl group, pentacosenyl group, isopentacosenyl group, hexacosenyl group, isohexacosenyl group, heptacosenyl group, and isoheptacosenyl group. Among them, $C_{15-21}$ aliphatic hydrocarbon groups are preferred and $C_{15-19}$ aliphatic hydrocarbon groups are more preferred.

There are no limitations on the method of producing the amide compound represented by general formula (2), and production may be carried out by any known method. However, the following are preferred because they allow easy production: methods in which a dehydration reaction is run between ammonia gas and 1 mol of the fatty acid given by $R^3COOH$, and methods in which a demethanolization reaction is run between ammonia gas and 1 mol of a fatty acid ester such as $R^3COOCH_3$.

The amide compound present in the particulate that constitutes the lubricant for metal powder metallurgy according to the present invention is selected from the group consisting of amide compounds represented by the preceding general formula (1) and amide compounds represented by the preceding general formula (2). The amide compound present in the particulate may be constituted of only one or more amide compounds with general formula (1), or may be constituted of only one or more amide compounds with general formula (2), or may be constituted of a mixture of one or more amide compounds with general formula (1) and one or more amide compounds with general formula (2). Among them, the amide compound is preferably a mixture of at least one amide compound with general formula (1) and at least one amide compound with general formula (2) and is more preferably a mixture of (A) an amide compound with general formula (3) below, (B) an amide compound with general formula (4) below, and (C) an amide compound with general formula (5) below or general formula (6) below, because this can provide excellent lubricity and low ejection force and can provide excellent rattler values.

$$R^4—CONH-(-CH_2-)_q-NHCO—R^5 \quad (3)$$

(in the formula, $R^4$ and $R^5$ each independently represent a $C_{13-27}$ straight-chain alkyl group and q represents a number from 1 to 6)

$$R^6—CONH_2 \quad (4)$$

(in the formula, $R^6$ represents a $C_{13-27}$ straight-chain alkyl group)

$$R^7—CONH-(-CH_2-)_r-NHCO—R^8 \quad (5)$$

(in the formula, $R^7$ and $R^8$ each independently represent a $C_{13-27}$ alkenyl group or branched alkyl group and n represents a number from 1 to 6)

$$R^9—CONH_2 \quad (6)$$

(in the formula, $R^9$ represents a $C_{13-27}$ alkenyl group).

In general formula (3) $R^4$ and $R^5$ each independently represent a $C_{13-27}$ straight-chain alkyl group. Examples of the straight-chain alkyl group include the tridecyl group, isotridecyl group, tetradecyl group, isotetradecyl group, pentadecyl group, isopentadecyl group, hexadecyl group, isohexadecyl group, heptadecyl group, isoheptadecyl group, octadecyl group, isooctadecyl group, nonadecyl group, isononadecyl group, eicosyl group, isoeicosyl group, heneicosyl group, isoheneicosyl group, docosyl group, isodocosyl group, tricosyl group, isotricosyl group, tetracosyl group, isotetracosyl group, pentacosyl group, isopentacosyl group, hexacosyl group, isohexacosyl group, heptacosyl group, and isoheptacosyl group. Among them, $C_{15-21}$ straight-chain alkyl groups are preferred and $C_{15-19}$ straight-chain alkyl groups are more preferred in terms of excellent lubricity.

In general formula (3) q is a number from 1 to 6, and the group between the two amide groups is then the methylene group, ethylene group, propylene group, butylene group, pentylene group, or hexylene group in correspondence to the change in q. Among them, q is preferably a number from 2 to 4 in terms of availability.

There are no limitations on the method of producing the amide compound with general formula (3), and it may be produced by any known method. However, the following are preferred because they allow easy production: a method in which a dehydration reaction is run between 1 mol of each of the fatty acids represented by $R^4COOH$ and $R^5COOH$ and, for example, methylenediamine, ethylenediamine, propylenediamine, butylenediamine, pentylenediamine, or hexylenediamine, and a method in which a demethanolization reaction is run between 1 mol of each of the fatty acid methyl esters represented by $R^4COOMe$ and $R^5COOMe$ and, for example, methylenediamine, ethylenediamine, propylenediamine, butylenediamine, pentylenediamine, or hexylenediamine.

In general formula (4) $R^6$ represents a $C_{13-27}$ straight-chain alkyl group. Examples of the straight-chain alkyl group include the tridecyl group, isotridecyl group, tetradecyl group, isotetradecyl group, pentadecyl group, isopentadecyl group, hexadecyl group, isohexadecyl group, heptadecyl group, isoheptadecyl group, octadecyl group, isooctadecyl group, nonadecyl group, isononadecyl group, eicosyl group, isoeicosyl group, heneicosyl group, isoheneicosyl group, docosyl group, isodocosyl group, tricosyl group, isotricosyl group, tetracosyl group, isotetracosyl group, pentacosyl group, isopentacosyl group, hexacosyl group, isohexacosyl group, heptacosyl group, and isoheptacosyl group. Among them, $C_{15-21}$ straight-chain alkyl groups are preferred and $C_{15-19}$ straight-chain alkyl groups are more preferred in terms of excellent lubricity.

There are no limitations on the method of producing the amide compound represented by general formula (4), and production may be carried out by any known method. However, the following are preferred because they allow easy production: methods in which a dehydration reaction is run between ammonia gas and 1 mol of the fatty acid given by $R^6COOH$, and methods in which a demethanolization reaction is run between ammonia gas and 1 mol of a fatty acid ester such as $R^6COOCH_3$.

In general formula (5) $R^7$ and $R^8$ each independently represent a $C_{13-27}$ alkenyl group or branched alkyl group. Examples of these groups include alkenyl groups such as the tridecenyl group, isotridecenyl group, tetradecenyl group, isotetradecenyl group, pentadecenyl group, isopentadecenyl group, hexadecenyl group, isohexadecenyl group, heptadecenyl group, isoheptadecenyl group, octadecenyl group, isooctadecenyl group, nonadecenyl group, isononadecenyl group, eicosenyl group, isoeicosenyl group, heneicosenyl group, isoheneicosenyl group, docosenyl group, isodocosenyl group, tricosenyl group, isotricosenyl group, tetracosenyl group, isotetracosenyl group, pentacosenyl group, isopentacosenyl group, hexacosenyl group, isohexacosenyl group, heptacosenyl group, and isoheptacosenyl group; and branched alkyl groups such as the isotridecyl group, isotetradecyl group, isopentadecyl group, isohexadecyl group, isoheptadecyl group, isooctadecyl group, isononadecyl group, isoeicosyl group, isoheneicosyl group, isodocosyl group, isotricosyl group, isotetracosyl group, isopentacosyl group, isohexacosyl group, and isoheptacosyl group. Among them, $C_{15-21}$ alkenyl groups or branched alkyl groups are preferred and $C_{15-19}$ alkenyl groups or branched alkyl groups are more preferred.

In general formula (5) r is a number from 1 to 6, and the group between the two amide groups is then the methylene group, ethylene group, propylene group, butylene group, pentylene group, or hexylene group in correspondence to the change in r. Among them, r is preferably a number from 2 to 4 in terms of availability.

There are no limitations on the method of producing the amide compound represented by general formula (5), and production may be carried out by any known method. However, the following are preferred because they allow easy production: methods in which a dehydration reaction is run between 1 mol of each of the fatty acids represented by $R^7COOH$ and $R^8COOH$ and, for example, methylenediamine, ethylenediamine, propylenediamine, butylenediamine, pentylenediamine, or hexylenediamine, and methods in which a demethanolization reaction is run between 1 mol of each of the fatty acid methyl esters represented by $R^7COOMe$ and $R^8COOMe$ and, for example, methylenediamine, ethylenediamine, propylenediamine, butylenediamine, pentylenediamine, or hexylenediamine.

In general formula (6) $R^9$ represent a $C_{13-27}$ alkenyl group. Examples of these groups include the tridecenyl group, isotridecenyl group, tetradecenyl group, isotetradecenyl group, pentadecenyl group, isopentadecenyl group, hexadecenyl group, isohexadecenyl group, heptadecenyl group, isoheptadecenyl group, octadecenyl group, isooctadecenyl group, nonadecenyl group, isononadecenyl group, eicosenyl group, isoeicosenyl group, heneicosenyl group, isoheneicosenyl group, docosenyl group, isodocosenyl group, tricosenyl group, isotricosenyl group, tetracosenyl group, isotetracosenyl group, pentacosenyl group, isopentacosenyl group, hexacosenyl group, isohexacosenyl group, heptacosenyl group, and isoheptacosenyl group. Among them, $C_{15-21}$ alkenyl groups are preferred and $C_{15-19}$ alkenyl groups are more preferred.

There are no limitations on the method of producing the amide compound represented by general formula (6), and production may be carried out by any known method. However, the following are preferred because they allow easy production: methods in which a dehydration reaction is run between ammonia gas and 1 mol of the fatty acid given by $R^9COOH$, and methods in which a demethanolization reaction is run between ammonia gas and 1 mol of a fatty acid ester such as $R^9COOCH_3$.

The amide compound (C) in the present invention is an amide compound represented by general formula (5) or an amide compound represented by general formula (6). An amide compound with general formula (6) is preferred as the amide compound (C) because this provides an excellent rattler value. Either an amide compound with general formula (5) or general formula (6) may be used for the amide compound (C) or their mixture may be used.

When the amide compounds (A) to (C) are used in the lubricant for metal powder metallurgy of the present invention, their blending ratios are not specified and any blending ratio may be used. However, in order to facilitate the expression of the effects of the present invention, 3 to 20 mass parts of component (B) and 0.3 to 5 mass parts of component (C) per 10 mass parts of component (A) are preferred; 5 to 15 mass parts of component (B) and 0.5 to 3 mass parts of component (C) per 10 mass parts of component (A) are more preferred; and 7 to 13 mass parts of component (B) and 0.7 to 1.5 mass parts of component (C) per 10 mass parts of component (A) are most preferred. When too little component (B) is present, the primary particles of the lubricant become hard, the compressibility and ejection force may deteriorate and the rattler value of the green body may increase. When too much component (B) is present, the lubricant particles may aggregate with each other, producing nonuniformities in the density of the sintered body and/or causing the surface of the sintered body to roughen. When too little component (C) is present, the rattler value of the green body may increase, the skin of the green body may undergo roughening and a poor appearance may then be produced. When too much component (C) is present, the lubricant particles may aggregate with each other, producing nonuniformities in the density of the sintered body and/or causing the surface of the sintered body to roughen.

The lubricant for metal powder metallurgy of the present invention may also contain other components within a range in which the effects of the present invention are not impaired. These other components can be exemplified by $C_{14-22}$ fatty acids; the methyl esters of $C_{14-22}$ fatty acids; esters between $C_{14-22}$ fatty acids and pentaerythritol; esters between $C_{14-22}$ fatty acids and ethylene glycol; graphite; polymer materials such as polyethylene waxes, thermoplastic elastomers, polyamides, and thermosetting resins; paraffins; carnauba wax; montan wax; and polyethers. When these are added, the added amount of 0.1 to 20 mass parts is preferred, the added amount of 0.5 to 10 mass parts is more preferred, and the added amount of 1 to 5 mass parts is even more preferred, in each case per 100 mass parts of the amide compound constituting the particulate.

Figure 2:
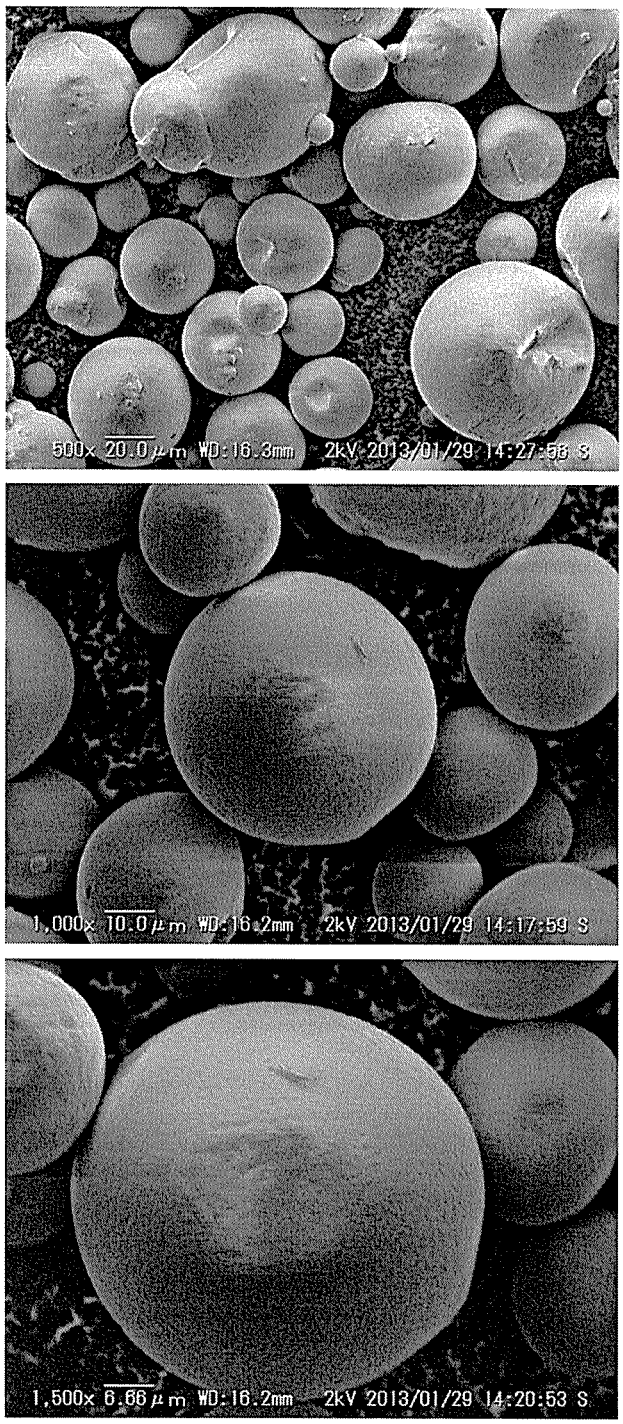
FIG. 2 is an electron micrograph of the lubricant for metal powder metallurgy according to the present invention, that has been obtained by a spray atomization method.

The lubricant for metal powder metallurgy of the present invention can be obtained by melt-mixing all of the components including the amide compound to obtain a homogeneous mixture, and forming particulates from the mixture. The melt-mixing method is not limited and a known method may be used. For example, melting may be carried out at a melting temperature of 80 to 250° C., preferably 100 to 200° C., and more preferably 120 to 180° C. The method of conversion to particulates is also not limited and a known method may be used, for example, methods in which pulverization is carried out on the material provided by solidification after the melt-mixing, and methods in which the melt-mixed solution is converted to particulates by spray atomization. FIG. 1 shows an electron micrograph of the lubricant for metal powder metallurgy obtained by pulverization of the material provided by solidification after melt-mixing; FIG. 2 shows an electron micrograph of the lubricant for metal powder metallurgy obtained by spray atomization of the melt-mixed solution. Spray atomization-based methods are preferred here because they enable control of particulates to a suitable size and because spherical particulates can be obtained.

The lubricant for metal powder metallurgy of the present invention is in the form of particulates, and there are limitations on the sizes of the particles therein. Particulates with a particle diameter of more than 198 μm must be less than 1 mass % (the ratio of the mass of particulates with a particle diameter of more than 198 μm to the total mass of the particulates is less than 1%) in the lubricant for metal powder metallurgy of the present invention, and are preferably not more than 0.1 mass %. The maximum particle diameter is more preferably not more than 198 μm; the maximum particle diameter is even more preferably not more than 150 μm; and the maximum particle diameter is most preferably not more than 100 μm. In addition, particulates with a particle diameter of not more than 10 μm must be not more than 10 mass % (the ratio of the mass of particulates with a particle diameter of 10 μm or less to the total mass of the particulates is equal to or less than 10%), and are preferably not more than 5 mass %, more preferably not more than 3 mass %, even more preferably not more than 1 mass %, and most preferably not more than 0.1 mass %. When particulates with a particle diameter of more than 198 μm are present at 1 mass % or more, the surface of the molding after metallurgical molding may not be smooth and a condition known as rough skin may occur, and/or large rattler values may occur. Moreover, when particulates with a particle diameter of not more than 10 μm are present at more than 10 mass %, the condition known as rough skin may occur, and/or large rattler values may occur. When these particulate sizes are outside the ranges of the present invention, moldings that present little chipping and an excellent density balance cannot be obtained. Thus, when the particle diameters after particle production are not within the ranges of the present invention, the particle diameters should be adjusted by, for example, classification using a sieve. In the present invention, particulates with a particle diameter of more than 198 μm denote particles that do not pass through a sieve with an aperture of 198 μm, while particulates with a particle diameter of not more than 10 μm denote particles that pass through a sieve with an aperture of 10 μm.

The lubricant for metal powder metallurgy of the present invention can be used regardless of the density of the resulting green body, but because it can provide low rattler values for the green body it is preferably used for the fabrication of easily chipped low-density green bodies.

The metal powder composition of the present invention is provided by the addition of 0.01 to 10 mass parts, preferably 0.01 to 5.0 mass parts, and more preferably 0.1 to 2.0 mass parts of the lubricant for metal powder metallurgy of the present invention to 100 mass parts of metal particles having a median diameter of 5 to 300

The method of the present invention for producing metal powder metallurgy products is a method in which the aforementioned metal powder composition is press molded to obtain a green body having a relative density, with respect to the ingot material having the same component composition as the metal particles, of not more than 90%, and this green body is sintered. The rattler value may increase when the amount of addition of the lubricant for metal powder metallurgy of the present invention is less than 0.01 mass parts, while the density of the green body may become nonuniform when the amount of addition exceeds 10 mass parts.

The metal particles used here should be metal particles that have a median diameter of 5 to 300 μm, but otherwise the metal particles heretofore known to be usable in powder metallurgy can be used without particular limitation, and examples are metal particles of iron, copper, tin, zinc, titanium, tungsten, molybdenum, nickel, chromium, and alloys of these metals. The alloys can be exemplified by iron-copper alloys, iron-copper-tin alloys, iron-copper-zinc alloys, iron-copper-zinc-tin alloys, copper-tin alloys, and copper-iron-tin-zinc alloys. Mixed powders of these metal powders, as provided by the addition of graphite powder to the aforementioned metal particles, can also be used. The ceramic particles heretofore used in powder metallurgy methods can also be used in the same manner as the aforementioned metal particles. When the metal particles used in the production of a low-density green body have a small median diameter, the density of the powder blend undergoes an increase, which then makes it difficult to obtain the sought-after low-density powder metallurgy product, and for this reason the median diameter of the metal particles is preferably 30 to 200 μm and more preferably 50 to 200 μm.

The density of the green body depends on the pressure in press molding. In particular, in order to obtain a low-density green body, the relative density with reference to the ingot material with the same component composition as the metal particles must not be more than 90%. In addition, the lower limit on the density of the low-density green body is not particularly limited; however, when this density is extremely low the metallurgy product will have a low strength and will be susceptible to breakage, and the relative density with reference to the ingot material with the same component composition as the metal particles is therefore preferably 50 to 90% and more preferably 60 to 80%.

The sintering method used in the method of the present invention for producing a metal powder metallurgy product is in no way limited, and any sintering method heretofore used in powder metallurgy can be used without impediment.

EXAMPLES

The present invention is described specifically below using examples and comparative examples.

The compounds were blended in the proportions (mass parts basis) shown in Table 1 and were melt-mixed to homogeneity at 150° C. followed by particulation using a spray atomizer. The particle diameter of the particulates was adjusted using the operating conditions for the spray atomizer. A portion of the obtained particulates was subjected to adjustment of the particle diameter and amount by classification using a sieve. The compounds used in the tests are listed below.

A-1: N,N'-ethylenebismyristamide ($R^4$=tridecyl group, $R^5$=tridecyl group, q=2)

A-2: N,N'-ethylenebisstearamide ($R^4$=heptadecyl group, $R^5$=heptadecyl group, q=2)

A-3: N,N'-ethylenebisbehenamide ($R^4$=heneicosyl group, $R^5$=heneicosyl group, q=2)

B-1: myristic acid monoamide ($R^6$=tridecyl group)

B-2: stearic acid monoamide ($R^6$=pentadecyl group)

B-3: behenic acid monoamide ($R^6$=heneicosyl group)

C-1: oleic acid monoamide ($R^9$=heptadecenyl group)

C-2: N,N'-ethylenebisoleamide ($R^7$=heptadecenyl group, $R^8$=heptadecenyl group, r=2)

C-3: N,N'-ethylenebisisostearamide ($R^7$=isoheptadecyl group, $R^8$=isoheptadecyl group, r=2)

TABLE 1

| | | Examples | | | | | | | | |
|---|---|---|---|---|---|---|---|---|---|---|
| | | 1 | 2 | 3 | 4 | 5 | 6 | 7 | 8 | 9 |
| Lubricant formulation | A-1 | | | | 47 | | | | | |
| | A-2 | 47 | 47 | 47 | | | 47 | 47 | 30 | 74 |
| | A-3 | | | | | 47 | | | | |
| | B-1 | | | | | | 47 | | | |
| | B-2 | 47 | 47 | 47 | 47 | 47 | | | 64 | 20 |
| | B-3 | | | | | | | 47 | | |
| | C-1 | 6 | | | 6 | 6 | 6 | 6 | 6 | |
| | C-2 | | 6 | | | | | | | 6 |
| | C-3 | | | 6 | | | | | | |
| Small particle amount (mass %) | | 0.1 | 0.1 | 0.1 | 0.1 | 0.1 | 0.1 | 0.1 | 0.1 | 0.1 |
| Large particle amount 1 (mass %) | | 0 | 0 | 0 | 0 | 0 | 0 | 0 | 0 | 0 |
| Large particle amount 2 (mass %) | | 0 | 0 | 0 | 0 | 0 | 0 | 0 | 0 | 0 |
| Large particle amount 3 (mass %) | | 0 | 0 | 0 | 0 | 0 | 0 | 0 | 0 | 0 |

Small particle amount: the mass percentage, with reference to the total mass of the particles, of particles having a particle diameter of equal to or less than 10 μm Large particle amount 1: the mass percentage, with reference to the total mass of the particles, of particles with a particle diameter of more than 198 μm Large particle amount 2: the mass percentage, with reference to the total mass of the particles, of particles with a particle diameter of more than 150 μm Large particle amount 3: the mass percentage, with reference to the total mass of the particles, of particles with a particle diameter of more than 100 μm

TABLE 2

| | | Examples | | | | | | | | |
|---|---|---|---|---|---|---|---|---|---|---|
| | | 10 | 11 | 12 | 13 | 14 | 15 | 16 | 17 | 18 |
| Lubricant formulation | A-1 | | | | | | | | | |
| | A-2 | 49 | 43 | 47 | 47 | 47 | 47 | 47 | 47 | 47 |
| | A-3 | | | | | | | | | |
| | B-1 | | | | | | | | | |
| | B-2 | 49 | 43 | 47 | 47 | 47 | 47 | 47 | 47 | 47 |
| | B-3 | | | | | | | | | |
| | C-1 | | | 6 | 6 | 6 | 6 | 6 | 6 | 6 |
| | C-2 | 2 | 14 | | | | | | | |
| | C-3 | | | | | | | | | |
| Small particle amount (mass %) | | 0.1 | 0.1 | 1 | 3 | 5 | 8 | 0.1 | 0.1 | 0.1 |
| Large particle amount 1 (mass %) | | 0 | 0 | 0 | 0 | 0 | 0 | 0 | 0 | 0 |
| Large particle amount 2 (mass %) | | 0 | 0 | 0 | 0 | 0 | 0 | 0 | 0 | 3 |
| Large particle amount 3 (mass %) | | 0 | 0 | 0 | 0 | 0 | 0 | 2 | 5 | 14 |

Small particle amount: the mass percentage, with reference to the total mass of the particles, of particles having a particle diameter of equal to or less than 10 μm
Large particle amount 1: the mass percentage, with reference to the total mass of the particles, of particles with a particle diameter of more than 198 μm
Large particle amount 2: the mass percentage, with reference to the total mass of the particles, of particles with a particle diameter of more than 150 μm
Large particle amount 3: the mass percentage, with reference to the total mass of the particles, of particles with a particle diameter of more than 100 μm

TABLE 3

| | | Example | | | Comparative examples | | | | |
|---|---|---|---|---|---|---|---|---|---|
| | | 19 | 20 | 21 | 1 | 2 | 3 | 4 | 5 |
| Lubricant formulation | A-1 | 50 | | | | | | | |
| | A-2 | | | 50 | 47 | 47 | 47 | 47 | 47 |
| | A-3 | | | | | | | | |
| | B-1 | 50 | | | | | | | |
| | B-2 | | 50 | | 47 | 47 | 47 | 47 | 47 |
| | B-3 | | | | | | | | |
| | C-1 | | 50 | | 6 | 6 | 6 | 6 | 6 |
| | C-2 | | | 50 | | | | | |
| | C-3 | | | | | | | | |
| Small particle amount (mass %) | | 0.1 | 0.1 | 0.1 | 0.1 | 0.1 | 12 | 18 | 12 |
| Large particle amount 1 (mass %) | | 0 | 0 | 0 | 1 | 5 | 0 | 0 | 1 |
| Large particle amount 2 (mass %) | | 0 | 0 | 0 | 7 | 11 | 0 | 0 | 6 |
| Large particle amount 3 (mass %) | | 0 | 0 | 0 | 18 | 25 | 0 | 0 | 17 |

Small particle amount: the mass percentage, with reference to the total mass of the particles, of particles having a particle diameter of equal to or less than 10 μm
Large particle amount 1: the mass percentage, with reference to the total mass of the particles, of particles with a particle diameter of more than 198 μm
Large particle amount 2: the mass percentage, with reference to the total mass of the particles, of particles with a particle diameter of more than 150 μm
Large particle amount 3: the mass percentage, with reference to the total mass of the particles, of particles with a particle diameter of more than 100 μm (Production of Green Bodies and Metallurgy Products)

Each of the lubricants for metal powder metallurgy obtained in Examples 1 to 21 and Comparative Examples 1 to 5 as described above was mixed with a metal powder (reduced pure iron powder with a median diameter of 75 μm (product name: NC100.24, from Hoganas AB)) in a proportion of 1 mass parts of the lubricant for metal powder metallurgy per 100 mass parts of the metal powder, and, after introduction into a W-cone mixer, mixing was carried out for 20 minutes with the rotation rate set to 25 to 30 rpm to produce a metal powder composition. Using a 3-ton cam press, the obtained metal powder composition was press molded, with adjustment of the relative density of the green body to 65 to 70% of the density for the ingot material with the same component composition as the metal powder, to fabricate low-density green bodies. These low-density green bodies were sintered by a common method to obtain low-density metallurgy products. The following tests were performed on the green bodies and the post-sintering metallurgy products. The results of the tests are given in Tables 4 to 6.

<The Rattler Value>

The rattler value of the green body was measured based on JPMA-P11-1992 using a standard die for powder compaction testing (internal diameter ϕ=11.285 mm, effective length=60 mm) as specified by the Japan Powder Metallurgy Association. The criterion for enabling mass production at the product level is a rattler value for the green body of not more than 3.0%.

<The Ejection Force and Density>

The ejection force of the green body from the die was measured based on JPMA-P13-1992 as follows: 7.0 g of the produced metal powder composition was accurately weighed out; this was poured into the cavity of the powder compaction test die; compression was carried out at a molding load of 800 MPa by sandwiching between upper and lower punches; only the upper punch was removed; and coverage with a cylindrical cap was carried out and the ejection force was measured. The diameter and height of the molding was measured with vernier calipers; the area of the curved surface was determined; and the ejection force per 1 $cm^2$ was designated the ejection force. In addition, for the density, the mass of the molding was measured using a precision balance and the mass per unit volume was taken to be the density.

<The Surface Roughness>

The surface of the metallurgy product obtained from sintering was enlarged 20× using a magnifying glass and the surface roughness was inspected visually. The evaluation was carried out according to the following criteria.

◎: The surface is smooth and entirely unproblematic at the product level.

○: A very slight roughness is observed in the surface, but this is unproblematic at the product level.

Δ: Disqualification as a product due to a conspicuous surface roughness.

x: Disqualification as a product due to a conspicuous surface roughness and the presence of depressions in the surface.

TABLE 4

| | Examples | | | | | | | | |
|---|---|---|---|---|---|---|---|---|---|
| | 1 | 2 | 3 | 4 | 5 | 6 | 7 | 8 | 9 |
| Rattler value (%) | 2.2 | 2.3 | 2.2 | 2.2 | 2.3 | 2.4 | 2.3 | 2.5 | 2.8 |
| Ejection force (MPa) | 2.4 | 2.4 | 2.5 | 2.4 | 2.4 | 2.5 | 2.4 | 2.7 | 2.6 |
| Density ($Mg/m^3$) | 5.19 | 5.20 | 5.19 | 5.20 | 5.21 | 5.21 | 5.20 | 5.22 | 5.22 |
| Surface roughness | ◎ | ◎ | ◎ | ◎ | ◎ | ◎ | ◎ | ○ | ◎ |

TABLE 5

| | Examples | | | | | | | | |
|---|---|---|---|---|---|---|---|---|---|
| | 10 | 11 | 12 | 13 | 14 | 15 | 16 | 17 | 18 |
| Rattler value (%) | 2.6 | 2.6 | 2.7 | 2.9 | 3.3 | 3.3 | 2.8 | 2.9 | 3.1 |
| Ejection force (MPa) | 2.5 | 2.7 | 2.5 | 2.7 | 2.5 | 2.6 | 2.8 | 2.6 | 2.7 |
| Density ($Mg/m^3$) | 5.25 | 5.27 | 5.25 | 5.28 | 5.30 | 5.29 | 5.32 | 5.31 | 5.30 |
| Surface roughness | ○ | ○ | ○ | ○ | ○ | ○ | ○ | ○ | ○ |

TABLE 6

| | Examples | | | Comparative examples | | | | |
|---|---|---|---|---|---|---|---|---|
| | 19 | 20 | 21 | 1 | 2 | 3 | 4 | 5 |
| Rattler value (%) | 2.3 | 2.9 | 2.9 | 3.9 | 4.1 | 4.4 | 5.9 | 4.8 |
| Ejection force (MPa) | 2.6 | 2.7 | 2.6 | 3.1 | 3.0 | 3.5 | 3.5 | 3.6 |
| Density ($Mg/m^3$) | 5.28 | 5.27 | 5.27 | 5.25 | 5.24 | 5.28 | 5.26 | 5.26 |
| Surface roughness | ◎ | ◎ | ◎ | X | X | Δ | Δ | X |

The invention claimed is:

1. A lubricant for metal powder metallurgy, consisting of particulates that contain (A) an amide compound represented by formula (3) below, (B) an amide compound represented by formula (4) below, and (C) an amide compound represented by formula (5) below or formula (6) below, wherein particulates with a particle diameter larger than 198 μm are less than 1 mass % and particulates with a diameter of 10 μm or less are not more than 10 mass %, $$R^4—CONH\text{-}(CH_2)\text{-}_q NHCO—R^5 \quad (3)$$

wherein, $R^4$ and $R^5$ each independently represent a $C_{13-27}$ straight-chain alkyl group and q represents a number from 1 to 6, $$R^6—CONH_2 \quad (4)$$

wherein, $R^6$ represents a $C_{13-27}$ straight-chain alkyl group, $$R^7—CONH\text{-}(CH_2)\text{-}_n NHCO—R^8 \quad (5)$$

wherein, $R^7$ and $R^8$ each independently represent a $C_{13-27}$ alkenyl group or branched alkyl group and n represents a number from 1 to 6, $$R^9—CONH_2 \quad (6)$$

wherein, $R^9$ represents a $C_{13-27}$ alkenyl group.

2. The lubricant for metal powder metallurgy according to claim 1, wherein the maximum particle diameter is not more than 100 μm and particulates with a particle diameter of 10 μm or less are not more than 1 mass %.

3. The lubricant for metal powder metallurgy according to claim 2, wherein an amount of component (B) is 3 to 20 mass parts and an amount of component (C) is 0.3 to 5 mass parts with reference to 10 mass parts of component (A).

4. A method of producing the lubricant for metal powder metallurgy according to claim 3, the method comprising: melt-mixing the amide compound, and then spraying the mixture to form particulates.

5. A metal powder composition comprising 0.01 to 10 mass parts of the lubricant for metal powder metallurgy according to claim 3, added to 100 mass parts of metal particles having a median diameter of 5 to 300 μm.

6. A method of producing a metal powder metallurgy product, the method comprising: mixing 0.01 to 10 mass parts of the lubricant for metal powder metallurgy according to claim 3, with 100 mass parts of metal particles having a median diameter of 5 to 300 μm; press molding the mixture to obtain a green body having a relative density, with respect to an ingot material having the same component composition as the metal particles, of not more than 90%; and sintering the green body to obtain a sintered body.

7. A method of producing the lubricant for metal powder metallurgy according to claim 2, the method comprising: melt-mixing the amide compound, and then spraying the mixture to form particulates.

8. A metal powder composition comprising 0.01 to 10 mass parts of the lubricant for metal powder metallurgy according to claim 2, added to 100 mass parts of metal particles having a median diameter of 5 to 300 μm.

9. A method of producing a metal powder metallurgy product, the method comprising: mixing 0.01 to 10 mass parts of the lubricant for metal powder metallurgy according to claim 2, with 100 mass parts of metal particles having a median diameter of 5 to 300 μm; press molding the mixture to obtain a green body having a relative density, with respect to an ingot material having the same component composition as the metal particles, of not more than 90%; and sintering the green body to obtain a sintered body.

10. A method of producing the lubricant for metal powder metallurgy according to claim 1, the method comprising: melt-mixing the amide compound, and then spraying the mixture to form particulates.

11. A metal powder composition comprising 0.01 to 10 mass parts of the lubricant for metal powder metallurgy according to claim 1, added to 100 mass parts of metal particles having a median diameter of 5 to 300 μm.

12. A method of producing a metal powder metallurgy product, the method comprising: mixing 0.01 to 10 mass parts of the lubricant for metal powder metallurgy according to claim 1, with 100 mass parts of metal particles having a median diameter of 5 to 300 μm; press molding the mixture to obtain a green body having a relative density, with respect to an ingot material having the same component composition as the metal particles, of not more than 90%; and sintering the green body to obtain a sintered body.

* * * * *